US008756759B2

(12) United States Patent
Kaestle et al.

(10) Patent No.: US 8,756,759 B2
(45) Date of Patent: Jun. 24, 2014

(54) FASTENING PLATE FOR A DOOR CLOSER AND DOOR CLOSING DEVICE HAVING SUCH A FASTENING PLATE

(75) Inventors: Karl-Heinz Kaestle, Albstadt (DE); Fritz Feucht, Renningen (DE)

(73) Assignee: ASSA ABLOY Sicherheitstechnik GmbH, Albstadt (DE)

( * ) Notice: Subject to any disclaimer, the term of this patent is extended or adjusted under 35 U.S.C. 154(b) by 0 days.

(21) Appl. No.: 13/636,383

(22) PCT Filed: Mar. 22, 2011

(86) PCT No.: PCT/EP2011/001426

§ 371 (c)(1),
(2), (4) Date: Oct. 26, 2012

(87) PCT Pub. No.: WO2011/116939

PCT Pub. Date: Sep. 29, 2011

(65) Prior Publication Data

US 2013/0047514 A1 Feb. 28, 2013

(30) Foreign Application Priority Data

Mar. 22, 2010 (DE) ..... 10 2010 012 264

(51) Int. Cl.
*E05F 1/00* (2006.01)

(52) U.S. Cl.
USPC ..... 16/71; 16/49

(58) Field of Classification Search
USPC ..... 16/71, 49, 51, 64, 66, 378, 58, 70, 65
See application file for complete search history.

(56) References Cited

U.S. PATENT DOCUMENTS

| | | | | | |
|---|---|---|---|---|---|
| 2,550,756 | A | * | 5/1951 | Bartoszek | 16/280 |
| 3,188,682 | A | * | 6/1965 | Check et al. | 16/49 |
| 4,086,681 | A | * | 5/1978 | Nakanishi | 16/49 |
| 4,179,092 | A | * | 12/1979 | Miyazawa | 248/309.1 |
| 4,763,384 | A | * | 8/1988 | Watabe | 16/53 |
| 4,831,687 | A | | 5/1989 | Lin et al. | |
| 4,847,946 | A | * | 7/1989 | Nam et al. | 16/53 |
| 5,357,725 | A | * | 10/1994 | Ferry | 52/210 |
| 5,623,747 | A | * | 4/1997 | Marinoni | 16/49 |

(Continued)

FOREIGN PATENT DOCUMENTS

| | | |
|---|---|---|
| DE | 198 48 071 | 4/2000 |
| DE | 200 02 515 | 5/2000 |

(Continued)

OTHER PUBLICATIONS

International Search Report of PCT/EP2011/001426, date of mailing Jul. 7, 2011.

(Continued)

*Primary Examiner* — Chuck Mah
(74) *Attorney, Agent, or Firm* — Collard & Roe, P.C.

(57) ABSTRACT

A door closing device has a door closer and a fastening plate for the door closer, having a receptacle side provided for receiving the door closer and having a support side opposite to the receptacle side, the sides being separated by a peripheral edge. At least one projection which protrudes outward on the edge is implemented on the peripheral edge, the projection being provided for the purpose of engaging in a formfitting manner in a corresponding recess on the door closer to be fastened, to thus cause an alignment of the door closer to be fastened relative to the fastening plate.

9 Claims, 1 Drawing Sheet

(56) References Cited

U.S. PATENT DOCUMENTS

| | | | | |
|---|---|---|---|---|
| 6,032,330 | A | 3/2000 | Chen | |
| 6,205,615 | B1 * | 3/2001 | Jensen et al. | 16/71 |
| 2006/0021189 | A1 * | 2/2006 | Johnson | 16/63 |

FOREIGN PATENT DOCUMENTS

| | | | |
|---|---|---|---|
| DE | 20 2005 000 543 | | 3/2005 |
| DE | 20 2007 005 265 | | 7/2007 |
| DE | 202007005265 | * | 7/2007 |
| EP | 0 481 473 | | 12/1997 |
| GB | 2 385 888 | | 8/2001 |

OTHER PUBLICATIONS

International Preliminary Report on Patentability of PCT/EP2011/001426 dated Sep. 25, 2012, and Written Opinion of the International Searching Authority.

* cited by examiner

FASTENING PLATE FOR A DOOR CLOSER AND DOOR CLOSING DEVICE HAVING SUCH A FASTENING PLATE

CROSS REFERENCE TO RELATED APPLICATIONS

This application is the National Stage of PCT/EP2011/001426 filed on Mar. 22, 2011, which claims priority under 35 U.S.C. §119 of German Application No. 10 2010 012 264.5 filed on Mar. 22, 2010, the disclosure of which is incorporated by reference. The international application under PCT article 21(2) was not published in English.

BACKGROUND OF THE INVENTION

1. Field of the Invention

The invention relates to a fastening plate for a door closer. Furthermore, the invention relates to a door closing device comprising such a fastening plate.

2. Description of the Related Art

A door closer is used for the purpose of automatically closing a building door. Such door closers are also used, e.g., in fire doors. The automatic closing movement is caused by a closing mechanism and/or closing electrical system integrated in the door closer.

So-called fastening plates (installation plates) are known for fastening such a door closer from the prior art, which are fastenable with a support side on a substrate provided for this purpose, e.g., a wall, a doorframe, a door leaf, or the like, and have a receptacle side opposite to the support side for receiving the door closer to be fastened. Such a fastening plate is known from DE 20 2007 005 265 U1.

Firstly, the fastening plate is fastened using the support side on the substrate provided for this purpose. The door closer is then installed on the receptacle side of the fastening plate. For this purpose, the door closer must be aligned relative to the fastening plate. This is performed in that the door closer having inserted fastening screws is pushed back and forth on the already fixed fastening plate to find the matching screw holes in the fastening plate. This is extraordinarily cumbersome in particular in the case of overhead installation.

SUMMARY OF THE INVENTION

The invention is therefore based on the object of remedying the above-mentioned disadvantages and improving the installation friendliness.

This object is achieved by a door closing device and a fastening plate as described herein. Preferred refinements are also described herein.

According to the invention, a fastening plate for a door closer is proposed, having a receptacle side provided for receiving the door closer and having a support side opposite to the receptacle side, these sides being separated by a peripheral edge and at least one projection that protrudes outward on the edge being formed on this peripheral edge, the projection being provided for the purpose of engaging in a formfitting manner in a corresponding recess on the door closer to be fastened, in order to thus cause an alignment of the door closer to be fastened relative to the fastening plate.

The projection, which protrudes outward or projects on the edge beyond the outer contour of the fastening plate, is used for the purpose of engaging in a formfitting manner in a corresponding recess, e.g., a groove or the like, on the door closer to be fastened, this recess preferably being formed in the housing (door closer housing) of the door closer. "Outer contour" means the outline of the geometrical basic shape (with respect to the horizontal projection, i.e., viewing direction perpendicular to the planar extension of the fastening plate). A plurality of projections are preferably provided on the fastening plate, which engage in a corresponding plurality of recesses on the door closer or door closer housing. Alignment and preferably also locking (fixing) of the door closer to be fastened is thus caused on the fastening plate. When the door closer is put on or pushed back and forth, a projection on the fastening plate catches in a recess provided for this purpose on the door closer or door closer housing, whereby the installation is substantially simplified. In addition to the alignment and optional locking function, a holding/fastening function can also be caused via the interlock produced between door closer and fastening plate. The fastening plate according to the invention can be produced in a cost-neutral manner in relation to the fastening plate known from DE 20 2007 005 265 U1.

According to a preferred refinement, it is provided that the fastening plate is implemented as essentially planar, and the at least one projection extends within the plane of the fastening plate. This means that the projection protruding outward on the edge is not angled or tailored in another manner. If multiple projections are provided, they preferably all lie within the plane of the fastening plate.

According to a preferred refinement, it is provided that the projection is implemented as a tongue. This tongue (in the horizontal projection) preferably has a substantially rectangular contour or shape. In particular, the width of the tongue is a multiple of the protruding length. The transitions between the peripheral edge and a projection or a tongue are preferably implemented as optimized with respect to the occurring tension curves. In the case of a plurality of projections or tongues, they are preferably implemented identically.

According to a preferred refinement, it is provided that the fastening plate has a substantially rectangular outer contour. The rectangular shape relates to a geometric basic shape of the fastening plate recognizable in horizontal projection. Deviations from the recognizable rectangular shape, e.g., rounded areas and/or waists, are preferably also to be included.

According to a preferred refinement, it is provided that the fastening plate comprises an even number of projections, which are arranged diametrically opposite in pairs on the long sides of the rectangular outer contour. A total of four projections are preferably provided.

According to a preferred refinement, it is provided that the fastening plate is implemented as a one-piece sheet-metal molded part. Such a sheet-metal molded part may be produced, e.g., as a stamped part in one work step. The thickness of the sheet-metal material is preferably in the range of 1 to 5 mm. In particular, this is a sheet steel material.

According to a preferred refinement, it is provided that the fastening plate has bores (through bores for fastening on a substrate), threaded bores (screw holes for screwing down the door closer), recesses, depressions, protrusions, and/or stiffening elements. (At least one individual one of the listed elements). In particular, it can be provided with respect to the bores and/or the threaded bores that multiple hole patterns are formed, whereby different installation positions are made possible, so that the fastening plate can also be used as an adapter plate. The bores and/or threaded bores can be implemented as countersunk on the receptacle side.

Furthermore, a door closing device is proposed according to the invention, comprising a fastening plate according to the invention and a door closer, the door closer being implemented having a door closer housing which receives the closing mechanism and/or closing electrical system, and which has a collar section, which at least partially overlaps and covers the peripheral edge of the fastening plate in the fastened state (i.e., with installed or fastened door closer), at least one recess (e.g., a groove) corresponding to the projection on the fastening plate being arranged in this collar section, which is intended for the formfitting engagement of the projection upon the fastening of the door closer on the fastening plate, in order to thus cause an alignment and optional locking of the door closer to be fastened relative to the fastening plate. Furthermore, the door closing device according to the invention can optionally comprise a cover (hood).

With the door closing device according to the invention, the installation or fastening of the door closer on the fastening plate can be performed rapidly and precisely. Through the interlocking engagement of the projection of the fastening plate in the recess provided for this purpose, an aligned position of the door closer relative to the fastening plate is exactly predefined. The door closer housing can also have multiple recesses in relation to one projection, however, whereby various alignment positions are made possible. It is preferably provided that the fastening plate has multiple projections and exactly one corresponding recess is provided in the collar section of the door closer housing for each of these projections, whereby multiple interlocking engagements can be caused.

An essential aspect of the door closing device according to the invention can also be seen in that the collar section of the door closer housing at least partially and preferably completely covers the edge of the fastening plate, so that the fastening plate is no longer visible when the door closer is installed or fastened (i.e., in the fastened state). This has technical and aesthetic advantages.

According to a preferred refinement, it is provided that the at least one recess in the collar section of the door closer housing is implemented as a recess which completely penetrates the housing wall. When the door closer is installed, the projection of the fastening plate engaging in a corresponding recess is therefore (externally) still visible. In this way, the installation can be simplified, since the projection and the corresponding recess can be brought into engagement in an obvious manner very easily. If there is a plurality of recesses, all recesses are preferably implemented in this manner.

According to another preferred refinement, it is provided that the at least one recess in the collar section of the door closer housing is only implemented on the inner side of the housing wall. I.e., the recess does not entirely penetrate the housing wall, but rather extends, e.g., only up to the middle of the door closer housing wall. When the door closer is installed, the projection of the fastening plate engaging in a corresponding recess is therefore not (externally) visible. If there is a plurality of recesses, all recesses are preferably implemented in this manner.

BRIEF DESCRIPTION OF THE DRAWINGS

The invention is explained in greater detail hereafter in a nonrestrictive manner on the basis of an exemplary embodiment illustrated in the figures. In the figures.

DETAILED DESCRIPTION OF THE PREFERRED EMBODIMENTS

Figure 1:
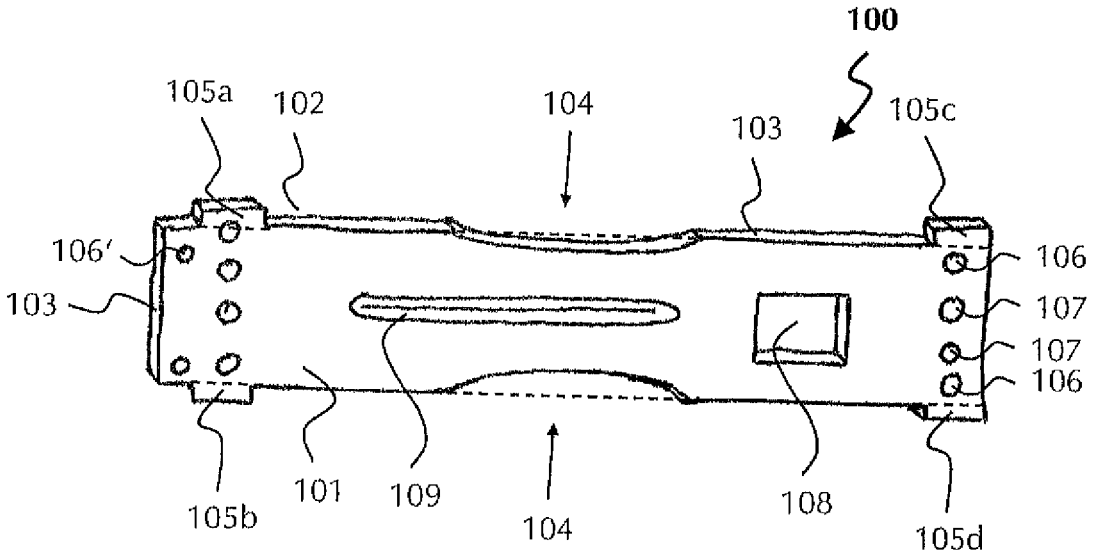
FIG. 1 shows a fastening plate according to the invention in a perspective view, looking toward the support side.

FIG. 1 shows a fastening plate according to the invention, identified as a whole by 100. The fastening plate 100, which is formed in one piece from a planar sheet-metal material, has a support side 101, for contact on a substrate provided for this purpose, and an opposing receptacle side 102 for receiving a door closer to be fastened or installed. The support side 101 and the receptacle side 102 are separated by a peripheral edge 103. The fastening plate 100 is implemented as a planar sheet-metal molded part and has a substantially rectangular outer contour in the horizontal projection (this means the outline of the geometric basic shape), which is illustrated by means of dashed auxiliary lines. The fastening plate 100 has opposing waists 104 on both longitudinal sides, which point inward in relation to the rectangular outer contour.

On the long sides of the peripheral edge 103, a total of four projections 105*a* to 105*d*, implemented as tongues, are arranged diametrically opposite in pairs, which are oriented outward or point outward in relation to the rectangular outer contour of the fastening plate 100 (according to the dashed auxiliary lines). The projections 105*a* to 105*d* have a rectangular shape in the horizontal projection. The width of the projections 105*a* to 105*d* is a multiple of the protruding length (in relation to the outer contour). The projections 105*a* to 105*d* are implemented as identical in the example, but can also have a differing implementation with respect to the shape and/or the dimensions.

Furthermore, the fastening plate 100 has multiple bores (through bores) 106 and threaded bores 107, which are arranged in the example in a row lying between the opposing projections 105*a*/105*b* and 105*c*/105*d*. Further bores are identified by 106'. In addition, the fastening plate 100 has a central recess 108 and a longitudinal notch 109, which is used as a stiffening element.

Figure 2:
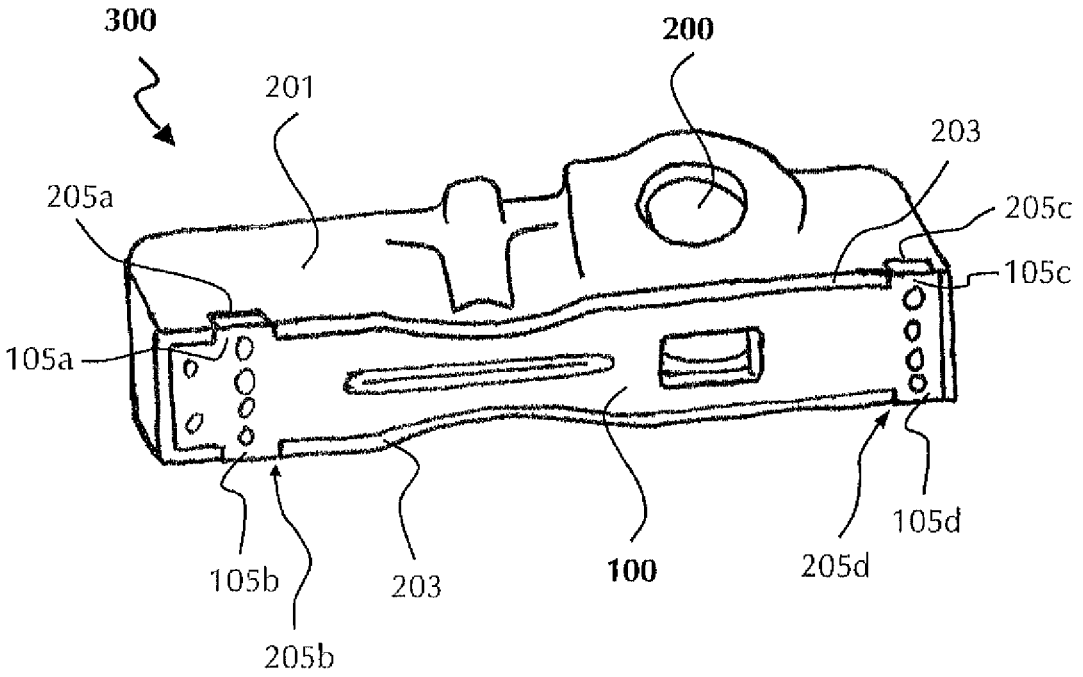
FIG. 2 shows a door closer installed or fastened on the fastening plate of FIG. 1, in the same perspective view.

The fastening plate 100 is fastened using the support side 101 on a substrate provided for this purpose (e.g., a wall, a doorframe, a door leaf, or the like), the fixing being performed by means of screws, which are guided coming from the receptacle side 102 through the bores 106. On the receptacle side 102 (not visible in the illustration), the bores 106 can be implemented as countersunk bores. A door closer 200 can accordingly be installed or fastened on the receptacle side 102, as shown in FIG. 2. The waists 104 and the recess 108 in the fastening plate 100 shown are used for adaptation to specific door closers 200. The fixing of the door closer 200 is performed by means of screws, which are inserted through corresponding bores or shafts in the housing 201 (door closer housing) of the door closer and engage coming from the receptacle side 102 in the threaded bores 107 (not shown in detail).

In order to simplify the installation of the door closer 200, it is placed on the receptacle side 102 of the fastening plate 100, which is already fastened on the substrate, and aligned relative to the fastening plate 100. The alignment is performed by multiple recesses 205*a*-205*d*, which are located in a collar section 203 of the door closer housing 201 and which are provided so that the projections or tongues 105*a*-105*d* on the fastening plate 100 can engage therein in a formfitting manner. Thus through the interlocking engagement of the projections 105*a*-105*d* in the respective corresponding recesses 205*a*-205*d*, the door closer 200 is brought into the correct position in relation to the fastening plate 100 and in particular aligned with the threaded bores 107. Screwing down is accordingly possible without problems. Through the interlocking engagement, forces and torques occurring during operation on the door closer 200 can also be dissipated into the fastening plate 100, so that a holding/fastening function can also be caused via the interlock thus caused.

As shown in FIG. 2, the collar section 203 associated with the door closer housing 201 overlaps the peripheral edge 103 of the fastening plate 100. I.e., the peripheral edge 103 is no longer visible when the door closer 200 is installed. The recesses 205*a*-205*d* in the collar section 203 of the door closer housing 201 are implemented as recesses which completely penetrate the housing wall in the collar section 203. The projections 105*a*-105*d* are thus also visible when the door closer 200 is installed, but are optionally covered by a cover (as explained hereafter). Notwithstanding the exemplary embodiment shown, the fastening plate 100 can be implemented as shorter than the door closer.

Alternatively, the recesses 205*a*-205*d* in the collar section 203 of the door closer housing 201 can only be implemented on the inner side of the housing wall, so that the projections 105*a*-105*d* are no longer visible when the door closer 200 is installed.

The door closing unit according to the invention includes the fastening plate 100 and the door closer 200. The door closing unit according to the invention is identified as a whole in FIG. 2 by 300. The door closing unit 300 preferably also comprises a cover (not shown), which can finally be slipped over the installed door closer 200. In this state, the door closing unit 300 made of fastening plate 100, door closer 200, and cover would be fully installed.

The invention claimed is:

1. A door closing device (300), comprising a door closer (200) and a fastening plate (100) for this door closer (200), the fastening plate (100) having a receptacle side (102) provided for receiving the door closer (200) and having a support side (101) opposite to the receptacle side (102), wherein the receptacle side and the support side are separated by a peripheral edge (103), and the door closer (200) having a door closer housing (201), wherein the door closer housing receives the closing mechanism and/or closing electrical system, and has a collar section (203) at least partially overlapping and covering the peripheral edge (103) of the fastening plate (100) in the fastened state, wherein at least one projection (105*a*-105*d*) protruding outward on the edge is implemented on the peripheral edge (103) of the fastening plate (100), and at least one recess (205*a*-205*d*) corresponding to the projection (105*a*-105*d*) on the fastening plate (100) is arranged in the collar section (203) of the door closer (200), and wherein the at least one recess is provided for the form-fitting interlocking engagement of the projection (105*a*-105*d*) on the fastening plate (100) upon the fastening of the door closer (200) on the fastening plate (100), in order to cause both alignment and also locking of the door closer (200) to be fastened relative to the fastening plate (100) through this engagement.

2. The door closing device (300) according to claim 1, wherein the fastening plate (100) is implemented as planar and the at least one projection (105*a*-105*d*) extends within the plane of the fastening plate (100).

3. The door closing device (300) according to claim 1, wherein the projection (105*a*-105*d*) on the fastening plate (100) is implemented as a tongue.

4. The door closing device (300) according to claim 1, wherein the fastening plate (100) has a substantially rectangular outer contour.

5. The door closing device (300) according to claim 4, wherein the fastening plate (100) has an even number of projections (105*a*-105*d*) arranged diametrically opposite in pairs (105*a*/105*b*; 105*c*/105*d*) on the long sides of the rectangular outer contour.

6. The door closing device (300) according to claim 1, wherein the fastening plate (100) is implemented in one piece as a sheet-metal molded part.

7. The door closing device (300) according to claim 1, wherein the fastening plate (100) has bores (106), threaded bores (107), recesses (108), depressions, protrusions, and/or stiffening elements (109).

8. The door closing device (300) according to claim 1, wherein the at least one recess (205*a*-205*d*) in the collar section (203) of the door closer housing (201) is implemented as a recess completely penetrating the housing wall.

9. The door closing device (300) according to claim 1, wherein the at least one recess (205*a*-205*d*) in the collar section (203) of the door closer housing (201) is only implemented on the inner side of the housing wall.

* * * * *